US010673165B1

(12) United States Patent
Wu

(10) Patent No.: US 10,673,165 B1
(45) Date of Patent: Jun. 2, 2020

(54) POWER CONNECTOR FOR BUILDING BLOCKS

(71) Applicant: WBStudio Technology Media Co., Ltd., Taoyuan (TW)

(72) Inventor: Haw-Yeu Wu, Taoyuan (TW)

(73) Assignee: WBStudio Technology Media Co., Ltd., Taoyuan (TW)

( * ) Notice: Subject to any disclaimer, the term of this patent is extended or adjusted under 35 U.S.C. 154(b) by 0 days.

(21) Appl. No.: 16/503,677

(22) Filed: Jul. 5, 2019

(51) Int. Cl.

| | |
|---|---|
| ***H01R 12/00*** | (2006.01) |
| ***H01R 13/42*** | (2006.01) |
| ***A63H 33/04*** | (2006.01) |
| ***H01R 12/72*** | (2011.01) |

(52) U.S. Cl.
CPC ..... *H01R 13/42* (2013.01); *A63H 33/044* (2013.01); *H01R 12/721* (2013.01)

(58) Field of Classification Search
CPC ..... H01R 12/62; H01R 12/79; H01R 12/592; H01R 13/42; H01R 12/721; H05K 1/118; H05K 3/326; A63H 33/044
USPC ..... 439/77, 67, 55; 361/741
See application file for complete search history.

(56) References Cited

U.S. PATENT DOCUMENTS 4,923,406 A * 5/1990 Bucknam ..... G11B 19/2009 439/77
5,186,632 A * 2/1993 Horton ..... H01R 12/62 439/493
5,663,870 A * 9/1997 Kerndlmaier ..... H05K 1/0228 174/260
5,938,462 A * 8/1999 Wilson ..... H01R 13/64 439/215
6,118,666 A * 9/2000 Aoki ..... H01R 12/61 174/254
6,150,614 A * 11/2000 Miller ..... H05K 1/0215 174/254
6,336,816 B1 * 1/2002 Yatskov ..... H01R 12/7005 439/493
6,529,377 B1 * 3/2003 Nelson ..... A61K 31/00 165/104.33
6,665,190 B2 * 12/2003 Clayton ..... H01L 23/13 257/E23.004
6,898,085 B2 * 5/2005 Haba ..... G06F 13/409 174/70 B
7,256,345 B2 * 8/2007 Inoue ..... B32B 15/02 174/110 R (Continued)

*Primary Examiner* — Abdullah A Riyami
*Assistant Examiner* — Vladimir Imas
(74) *Attorney, Agent, or Firm* — Alan D. Kamrath; Mayer & Williams PC

(57) ABSTRACT

A power connector for building blocks has a loading sheet adapted to be mounted between two assembled building blocks and a socket mounted on the loading sheet. The loading sheet has a locating segment and a conducting unit. The locating segment forms a through hole. The conducting unit is mounted on a surface of the locating segment. The socket is electrically connected to the conducting unit and is used to connect to a wire. The power connector is mounted between the two assembled building blocks by the loading sheet and is mounted around any column of another building block via the through hole. Thus, the power connector is mounted on the building blocks without pasting and drilling and therefore without breaking the building blocks. Besides, the power connector is manufactured by automation so that cost is reduced and the quality is stable.

10 Claims, 8 Drawing Sheets

(56) References Cited

U.S. PATENT DOCUMENTS 7,566,238 B2 * 7/2009 Tracy ..... G06F 1/185 439/2
7,652,890 B2 * 1/2010 Ohsawa ..... G11B 5/486 174/254
7,751,016 B2 * 7/2010 Abe ..... G02F 1/13452 349/150
8,039,754 B2 * 10/2011 Fink ..... B60R 16/0215 174/251
8,113,888 B2 * 2/2012 Carter ..... H01R 9/03 439/676
8,466,891 B2 * 6/2013 Kim ..... G06F 3/044 345/104
8,475,197 B2 * 7/2013 Zerebilov ..... H01R 13/6275 439/352
8,481,855 B2 * 7/2013 Shinoda ..... H05K 1/028 174/254
8,482,928 B2 * 7/2013 Capeleto ..... H05K 1/148 174/260
8,562,149 B2 * 10/2013 Hu ..... G03B 21/145 348/771
8,586,872 B2 * 11/2013 Sugiura ..... H05K 1/05 174/252
9,093,801 B2 * 7/2015 Williams ..... H01R 12/716
9,136,633 B2 * 9/2015 Dods ..... H01R 13/42
9,225,115 B2 * 12/2015 Malek ..... H01R 12/7047
9,246,262 B2 * 1/2016 Brown ..... H01R 13/6275
9,572,285 B2 * 2/2017 Long ..... H01R 12/721
9,583,865 B2 * 2/2017 Sharf ..... H01R 12/721
9,647,364 B2 * 5/2017 Komoto ..... H01R 12/718
9,748,718 B2 * 8/2017 Huang ..... H01R 12/721
9,774,120 B2 * 9/2017 Liao ..... H01R 12/7005
9,991,616 B2 * 6/2018 Axelowitz ..... G06F 1/1613
10,461,473 B1 * 10/2019 Hsiao ..... H01R 13/639
10,485,106 B2 * 11/2019 Roh ..... H05K 1/14
2012/0329305 A1 * 12/2012 Ritter ..... H01R 13/6275 439/350
2013/0109201 A1 * 5/2013 Wu ..... H01R 12/7005 439/59

* cited by examiner

POWER CONNECTOR FOR BUILDING BLOCKS

BACKGROUND OF THE INVENTION

1. Field of the Invention

The present invention relates to a component of building blocks, especially to a power connector for building blocks with lighting units.

2. Description of the Prior Arts

Nowadays, building block toys comprise lighting units to enhance fun and dynamics at play. The lighting units need to be connected to a power source by wires to light up. However, a building block construction has many parts stacked up. As the lighting units in each part are connected to each other by wires, the parts will be linked by the wires and become undetachable, so the whole building block construction is not applicable for hands-on playing but is turned into a decoration.

Therefore, a power connecting structure is provided to solve this shortcoming. The power connecting structure has a conducting sheet and a pin. The manufacturer pastes the conducting sheet to a top surface of a building block of the lower part, drills a hole on a bottom surface of a building block of the upper part, and mounts the pin through the hole. The lighting units in each part are connected to the conducting sheet and the pin by wires. Therefore, when the lower part and the upper part are assembled, the pin in the upper part abuts the conducting sheet in the lower part and conducts electricity. By doing so, the upper and lower parts are not linked by wires and therefore are not limited by the wires anymore.

However, the power connecting structure has the disadvantages as follows.

First, to paste the conducting sheet and to drill the hole is to break the building block itself. This may hinder the market acceptance.

Second, pasting the conducting sheet and drilling the hole are both done manually so time consumption and labor cost are high, and the quality is also hard to monitor and control.

To overcome the shortcomings, the present invention provides a power connector for building blocks to mitigate or obviate the aforementioned problems.

SUMMARY OF THE INVENTION

The main objective of the present invention is to provide a power connector for building blocks that is adapted to be mounted on building blocks without breaking them. In addition, the power connector is manufactured by automation, so that the cost is reduced and the quality is stable.

The power connector for building blocks has a loading sheet and a socket. The loading sheet is adapted to be mounted between the two assembled building blocks and has a locating segment and a conducting unit. The locating segment forms a through hole. The through hole is adapted for a column of one of the two building blocks to mount through the through hole. The conducting unit is mounted on a surface of the locating segment. The socket is mounted on the loading sheet and is electrically connected to the conducting unit. The socket is adapted to be connected to a wire.

The power connector is mounted between two assembled building blocks by the loading sheet and is mounted around the column of any building block via the through hole. Thus, the power connector is mounted on the building blocks without pasting and drilling, which means without breaking any building block. For use, a player mounts two power connectors on the upper building block and the lower building block respectively. When assembling the upper building block and the lower building block, the player mounts the two power connectors around the same column on the top of the lower building block by the two through holes and abut the two conducting units on each other. Thus, by connecting the wires of the two building blocks with the two sockets of the two power connectors respectively, the lighting units in each building block are conducted. Therefore, after the two building blocks are detached, the two power connectors, which are respectively mounted on the two building blocks, are detached from each other, forming an open circuit so that the two building blocks will not be linked and limited by wires. By this, the lighting units light up when the building blocks are assembled and light out when the building blocks are detached. In summary, the present invention is able to be mounted on building blocks without breaking them and is manufactured by automation so that the cost is reduced and the quality is stable.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
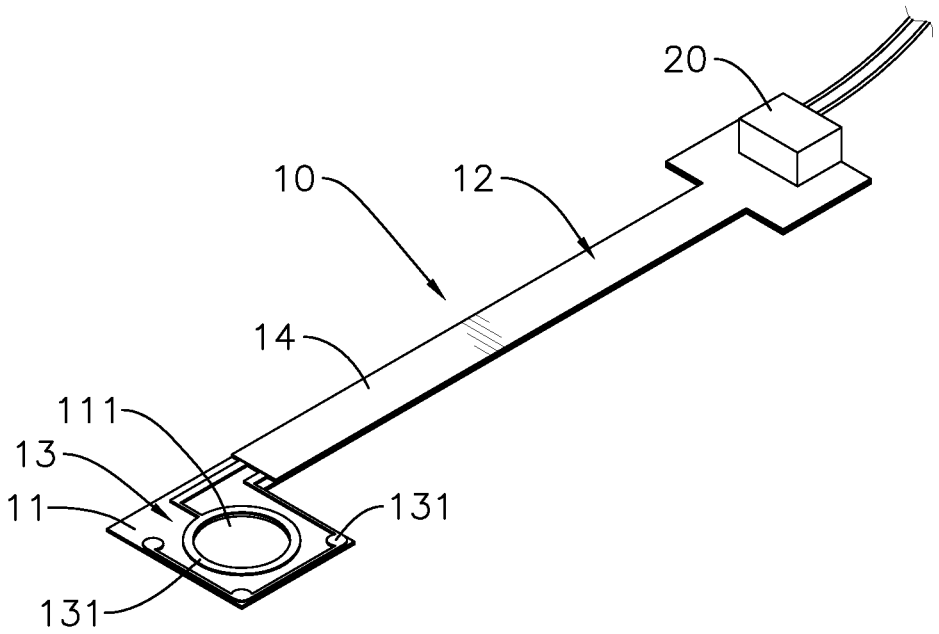
FIG. 1 is a perspective view of a power connector for building blocks in accordance with the present invention.

With reference to FIG. 1, a power connector for building blocks in accordance with the present invention is adapted to be mounted between two assembled building blocks and comprises a loading sheet 10 and a socket 20.

The loading sheet 10 is adapted to be mounted between two assembled building blocks and comprises a locating segment 11, an insertion segment 12, a conducting unit 13, and an insulation layer 14. Specifically, in this embodiment, the loading sheet 10 is, but not limited to, a Flexible Printed Circuit. The conducting unit 13 is, but not limited to, coated on a surface of the locating segment 11. The loading sheet 10 can also be an ordinary sheet rather than a Flexible Printed Circuit and the conducting unit 13 can also be a metal sheet or a metal wire pasted on the locating segment 11. In addition, in this embodiment, the thickness of the loading sheet 10 is equal to or less than 0.09 millimeter so that there is no gap between the two assembled building blocks when the loading sheet 10 is mounted between the two assembled building blocks. But the thickness of the loading sheet 10 is not limited to less than 0.09 millimeter.

Figure 2:
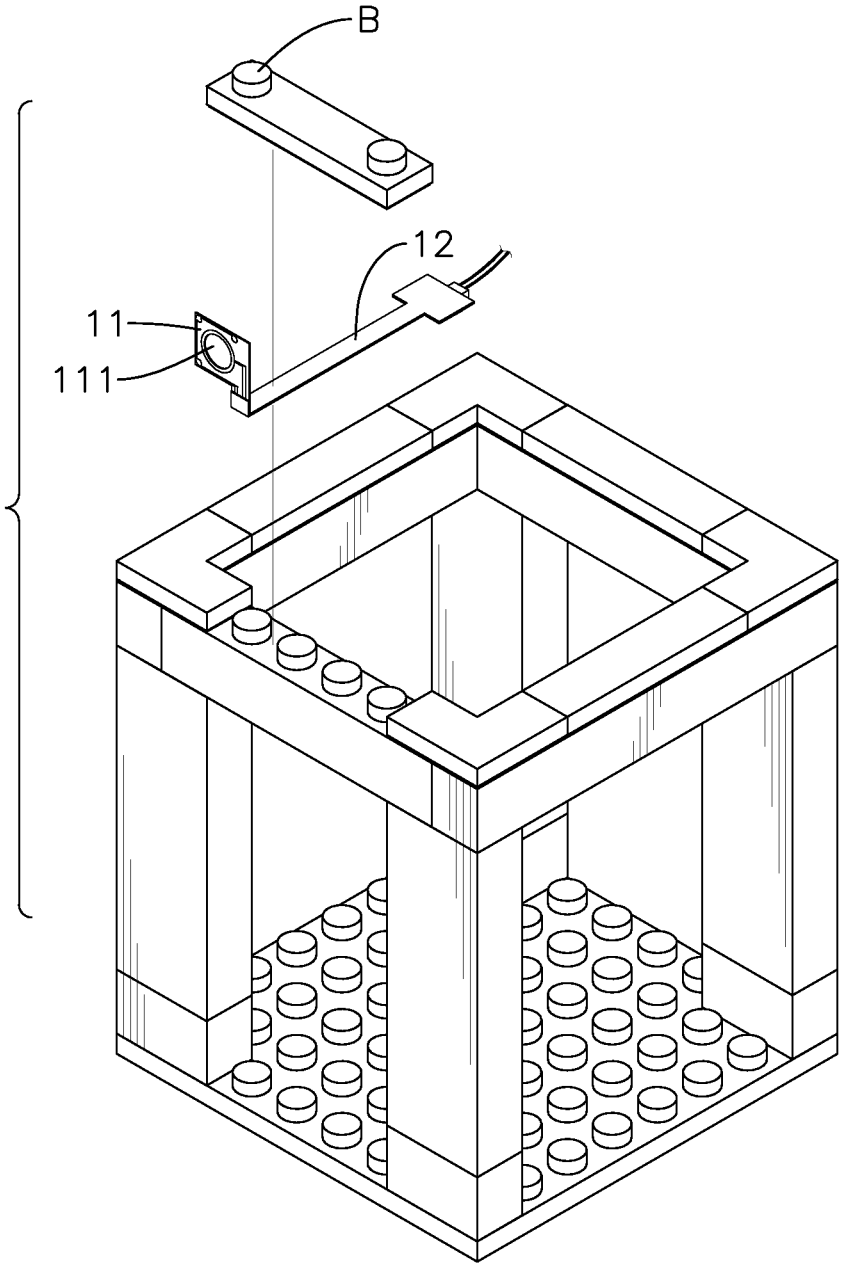
FIGS. 2 and 3 are perspective operational views of the power connector for building blocks in FIG. 1; showing the power connector being mounted on the lower building block.
Figure 3:
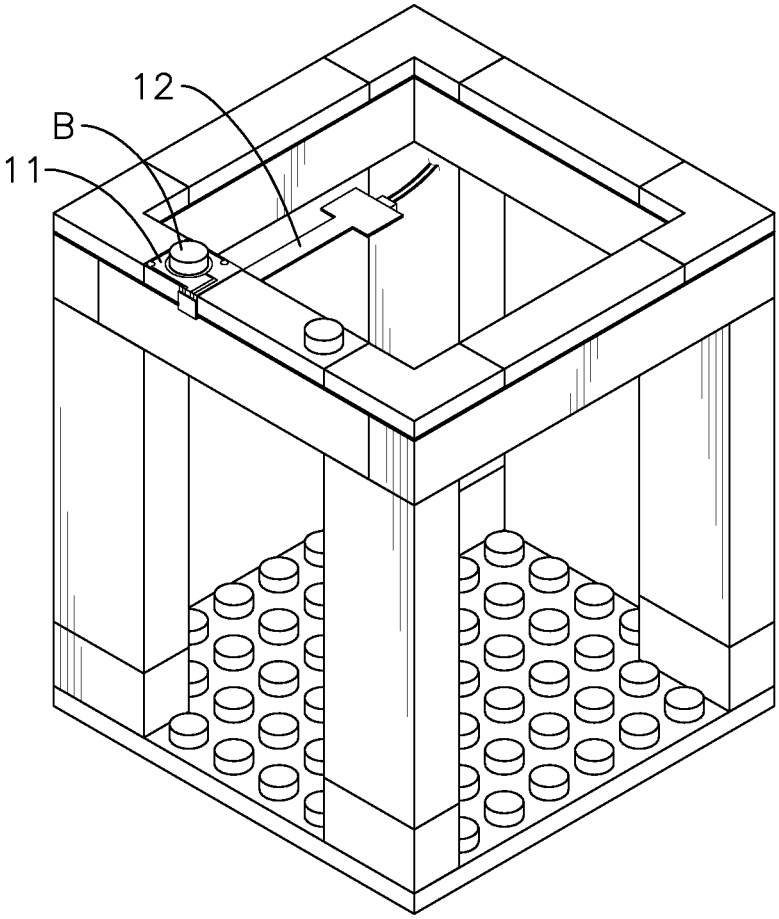

With further reference to FIGS. 2 and 3, the locating segment 11 forms a through hole 111. The through hole 111 is used to be disposed around a column B of one of the two building blocks. Thus, the loading sheet 10 is adapted to be mounted on building blocks without breaking them.

Figure 4:
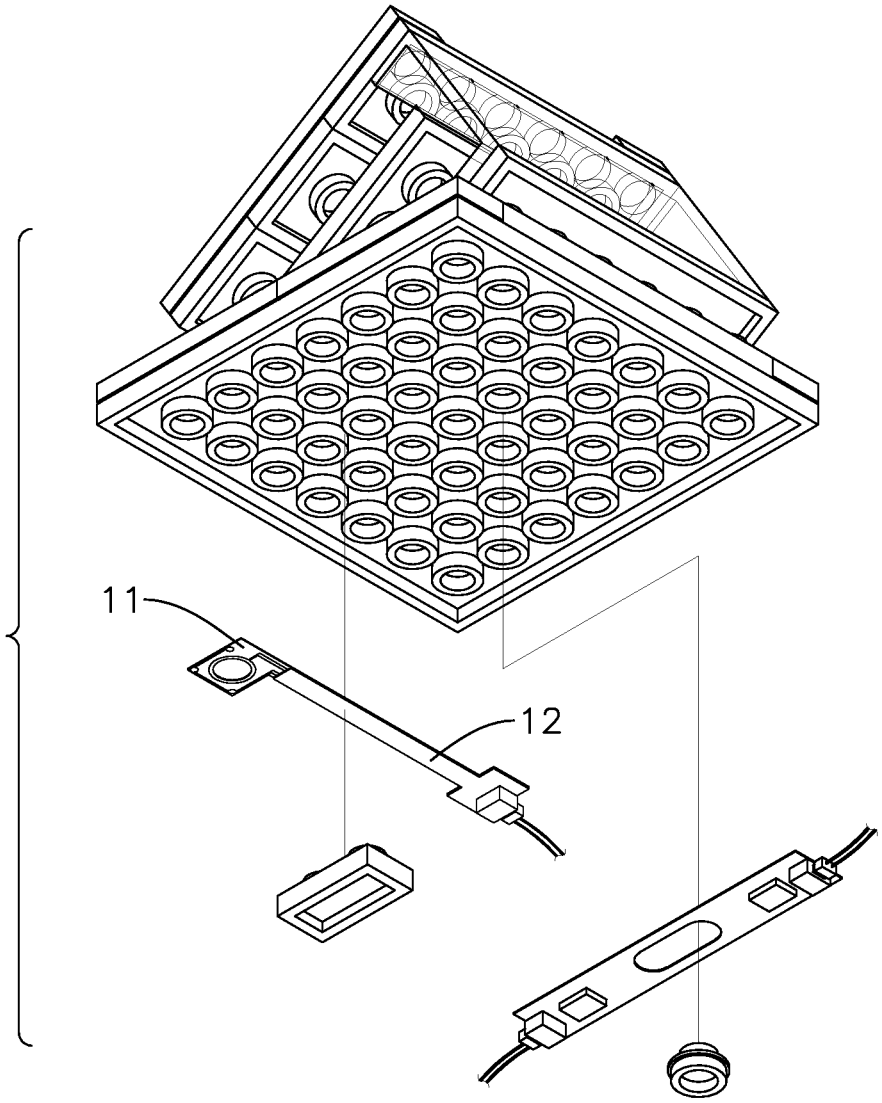
FIGS. 4 and 5 are perspective operational views of the power connector for building blocks in FIG. 1; showing the power connector being mounted on the upper building block.
Figure 5:
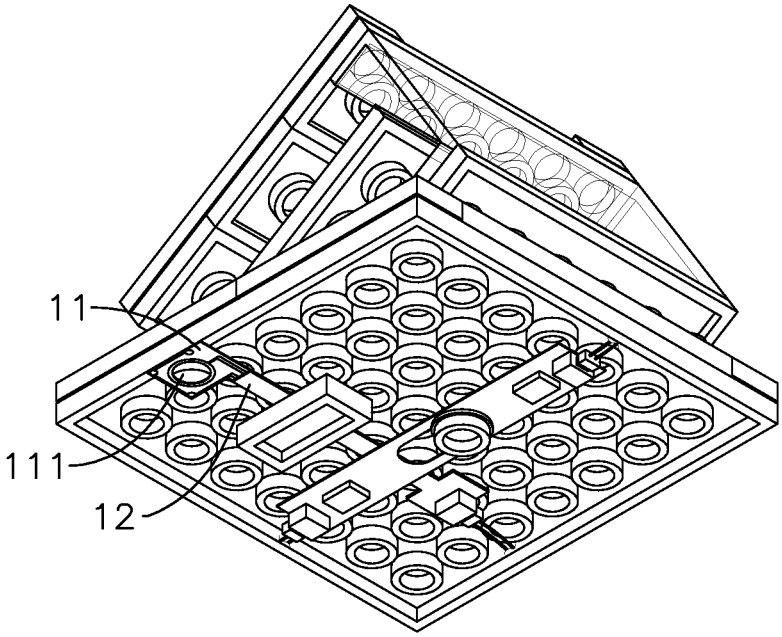

With further reference to FIGS. 4 and 5, an end of the insertion segment 12 is connected to the locating segment 11 and the socket 20 is mounted on the other end of the insertion segment 12. Moreover, a width of the insertion segment 12 is smaller than a distance between any two adjacent columns of any one of the two building blocks. In other words, the insertion segment 12 can be mounted between any two adjacent columns of any one of the two building blocks so that the insertion segment 12 can be clamped by the two building blocks to fix the loading sheet 10. Thus, the loading sheet 10 can be mounted on a bottom surface of a lower one of the two building blocks by the insertion segment 12 clamped by the two building blocks. However, the width of the insertion segment 12 is not limited to be uniform; the width can also be varied as long as the narrow part of the insertion segment 12 is smaller than the distance between any two adjacent columns of any of the two building blocks, that is, the wide part of the insertion segment 12 can be bigger than the columns for positioning.

In accordance with the above, in this embodiment, the loading sheet 10 can be mounted on the building blocks in two different ways. One, which is used to mount the loading sheet 10 on the column B of the top of the lower building block, is to dispose the through hole 111 of the locating segment 11 around the column B of the building block (as shown in FIGS. 2 and 3). The other, which is used to mount the loading sheet 10 on the bottom surface of the upper building block, is to clamp the insertion segment 12 of the loading sheet 10 between the bottom surface of the upper building block and another building block, and the insertion segment 12 is located between two columns of said another building block.

Figure 7:
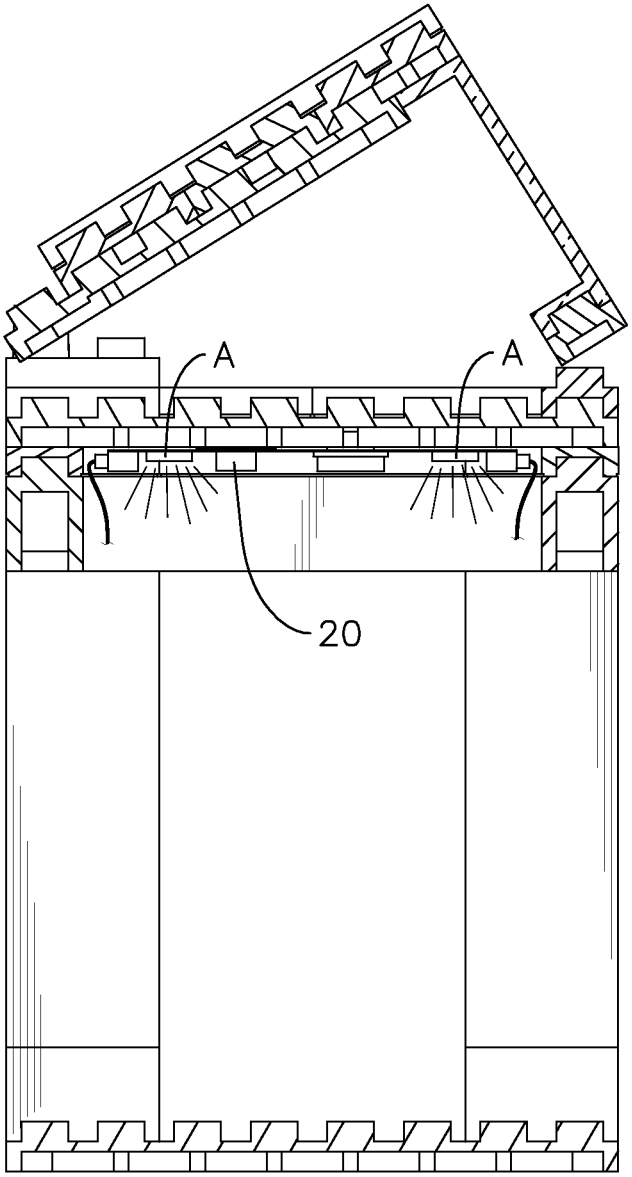
Figure 8:
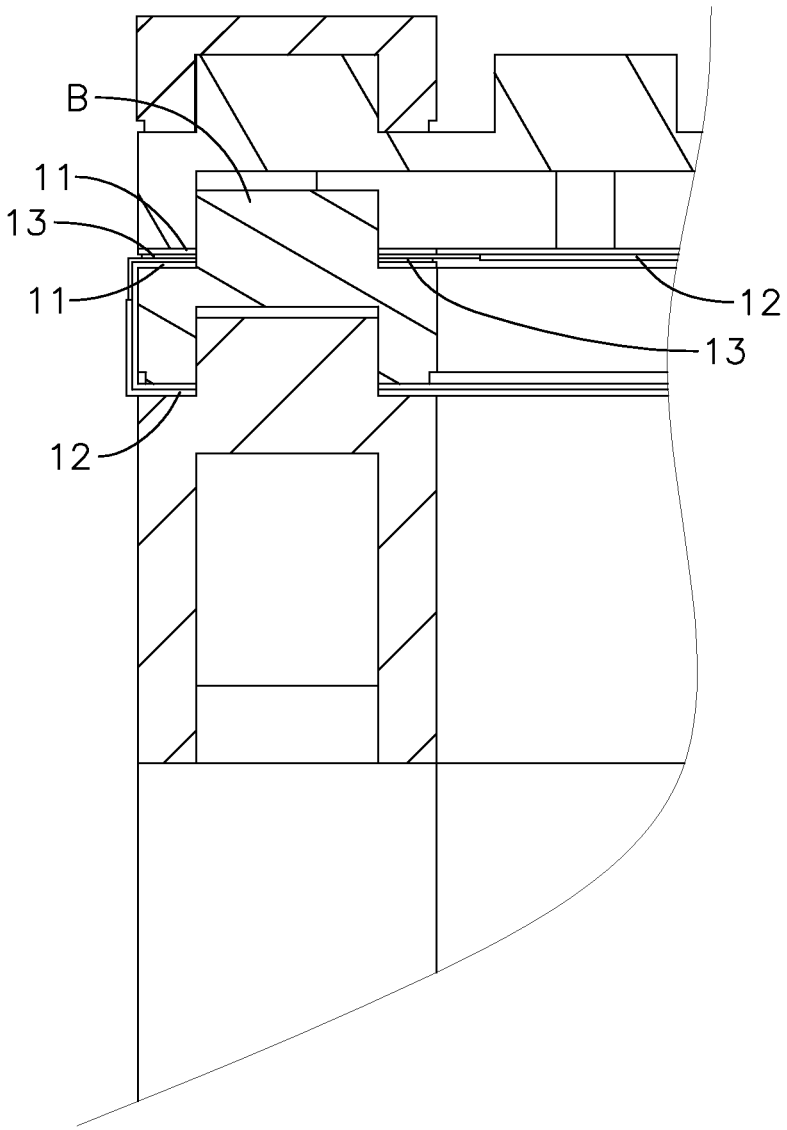
FIG. 8 is a side view in cross section of the power connector for building blocks in FIG. 1; showing the power connector conducting the upper and lower building blocks.

By this, when the upper and the lower building blocks are assembled, the loading sheet 10 in the upper building block will be mounted around the same column B as the loading sheet 10 in the lower building block via their respective through hole 111, and then the two conducting units 13 of the two loading sheets 10 abut each other so that the circuits in the upper and the lower building blocks are conducted (as shown in FIGS. 7 and 8).

When the upper and the lower building blocks are detached, the two loading sheets 10 in the two building blocks are detached, and each loading sheet 10 is still mounted on the original location. But it is not limited to the abovementioned, as the loading sheet 10 can be implemented without the insertion segment 12. In this way, when the upper and the lower building blocks are assembled, the two loading sheets 10 in the two building blocks are still mounted around the same column B via their respective through holes 111 and abut on each other and remain conductive. But when the two building blocks are detached, the loading sheet 10 in the upper building block is fixed on the bottom surface of the upper building block by another structure or the loading sheet 10 is not fixed.

With further reference to FIG. 1, the conducting unit 13 is mounted on a surface of the locating segment 11. Specifically, in this embodiment, the conducting unit 13 extends to a surface of the insertion segment 12 and extends from one end of the insertion segment 12 to the other end and is electrically connected to the socket 20. But it is not limited to the abovementioned, as the conducting unit 13 can also be mounted on the surface of the locating segment 11 but does not extend to the surface of the insertion segment 12. In this way, the conducting unit 13 is electrically connected to the socket 20 by a wire. In addition, in this embodiment, the conducting unit 13 has two electrodes 131 spaced apart from each other. One of the electrodes 131 is mounted on the periphery of the through hole 111 and the other electrode 131 is mounted on the periphery of the locating segment 11. The two electrodes 131 are electrically connected to the socket 20. By this, the conducting unit 13 ensures the two building blocks remain conducted even when the two building blocks rotate relative to each other, but it is not limited to the abovementioned.

The insulation layer 14 is mounted on the insertion segment 12 and covers the conducting unit 13 on the insertion segment 12. But it is not limited to the abovementioned, as the loading sheet 10 can be implemented without the insulation layer 14 in an embodiment that the conducting unit 13 does not extend to the insertion segment 12 or in an embodiment without the insertion segment 12.

The socket 20 is mounted on the loading sheet 10 and is electrically connected to the conducting unit 13. The socket 20 is to connect to a wire. Specifically, in this embodiment, the socket 20 has a base and a conductor. The base is mounted on the loading sheet 10 and forms an engaging groove. The conductor is mounted in the engaging groove, is mounted through the base, and is electrically connected to the conducting unit 13. Therefore, by mounting a plug, which is in a same shape with the engaging groove, on an end of the wire, the socket 20 is assembled with the wire conveniently and is stably electrically connected to the wire. But it is not limited to the abovementioned, as the socket 20 can be implemented without the base and the conductor. In this case, the socket 20 can be metal and is electrically connected to the conducting unit 13, and the wire is welded on the socket 20 directly.

When in use, two power connecters of the present invention cooperate with each other in a pair. One is mounted on the top of the lower building block as the other is mounted on the bottom of the upper building block.

With further reference to FIGS. 2 and 3, for the power connecter that is mounted on the top of the lower building block, the insertion segment 12 is clamped between the two building blocks first in order to be mounted firmly. Then the loading sheet 10 is folded and the through hole 111 of the locating segment 11 is disposed around the column B of the upper building block and the conducting unit 13 faces upward. But the insertion segment 12 is not limited to be clamped between the two building blocks, and the loading sheet 10 can be mounted on the building block via only the through hole 111 of the locating segment 11 disposed around the column.

With further reference to FIGS. 4 and 5, the power connecter that is mounted on the bottom surface of the upper building block is clamped by another building block and the bottom surface of the upper building block. Specifically, the insertion segment 12 of the power connecter is located between any two adjacent columns of said another building block, and said another building block is assembled with the bottom surface of the upper building block by its columns. Thus, the power connecter is mounted on the bottom surface of the upper building block by said another building block clamping the insertion segment 12. Besides, the socket 20 of the power connecter which is mounted on the upper building block is connected to a wire and is electrically connected to a lighting unit A via the wire.

Figure 6:
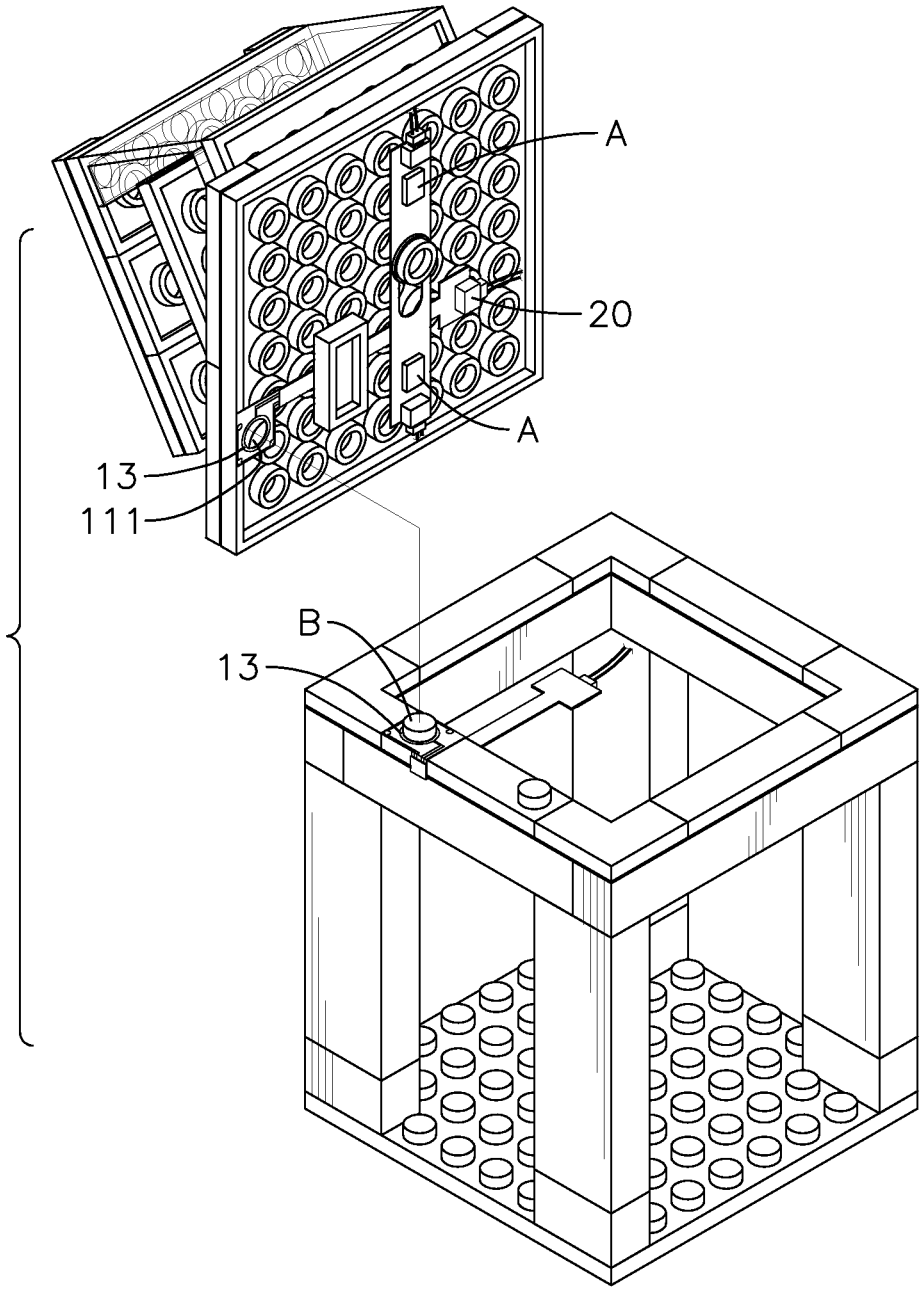
FIGS. 6 and 7 are perspective operational views of the power connector for building blocks in FIG. 1; showing the upper and lower building blocks being assembled to each other.

With further reference to FIGS. 6 and 8, when the upper and the lower building blocks are assembled, the loading sheet 10 in the upper building block is mounted around the same column B as the loading sheet 10 in the lower building block via its respective through hole 111, and then the two conducting units 13 of the two loading sheets 10 abut each other so that the circuits in the upper and the lower building blocks are conducted. Therefore, the two conducting units 13 form a close loop and the lighting unit A lights up.

The power connector is mounted between two assembled building blocks by the loading sheet 10 and is mounted around the column B of any building block via the through hole 111. Thus, the power connector is mounted on the building blocks without pasting and drilling, which means without breaking any building block.

For use, a player mounts two power connectors on the upper and the lower building blocks respectively. When assembling the upper and the lower building blocks, the player mounts the two power connectors around the same column B on the top of the lower building block via the two through holes 111 and abut the two conducting units 13 on each other. Thus, by connecting the wires of the two building blocks with the two sockets 20 of the two power connectors respectively, the lighting units A in the two building blocks are conducted. Therefore, after the two building blocks are detached, the two power connectors, which are respectively mounted on the two building blocks, are detached from each other and form an open circuit so that the two building blocks will not be linked and limited by wires. By this, the lighting units A light up when the building blocks are assembled and light out when the building blocks are detached.

In addition, a Flexible Printed Circuit can be manufactured by automation so that the cost is reduced and the quality is stable.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A power connector adapted to be mounted between two assembled building blocks; the power connector comprising:

a loading sheet adapted to be mounted between the two assembled building blocks and having a locating segment forming a through hole; the through hole adapted for a column of one of the two building blocks to mount through the through hole; and a conducting unit mounted on a surface of the locating segment; and a socket mounted on the loading sheet and electrically connected to the conducting unit; the socket adapted to be connected to a wire.

2. The power connector as claimed in claim 1, wherein the loading sheet further has an insertion segment having two ends; one of the two ends of the insertion segment connected to the locating segment; the socket mounted on the other end of the insertion segment; a width of the insertion segment being smaller than a distance between any two adjacent columns of any one of the two building blocks.

3. The power connector as claimed in claim 2, wherein the conducting unit extends to the insertion segment; the conducting unit extends to the two ends of the insertion segment to be electrically connected to the socket.

4. The power connector as claimed in claim 3, wherein the loading sheet further has an insulation layer mounted on the insertion segment and covering the conducting unit on the insertion segment.

5. The power connector as claimed in claim 1, wherein the conducting unit has two electrodes spaced apart from each other; one of the electrodes mounted on a periphery of the through hole and the other electrode mounted on a periphery of the locating segment; the two electrodes both electrically connected to the socket.

6. The power connector as claimed in claim 4, wherein the conducting unit has two electrodes spaced apart from each other; one of the electrodes mounted on a periphery of the through hole and the other electrode mounted on a periphery of the locating segment; the two electrodes both electrically connected to the socket.

7. The power connector as claimed in claim 1, wherein the loading sheet is a Flexible Printed Circuit.

8. The power connector as claimed in claim 6, wherein the loading sheet is a Flexible Printed Circuit.

9. The power connector as claimed in claim 1, wherein a thickness of the loading sheet is equal to or less than 0.09 millimeter.

10. The power connector as claimed in claim 8, wherein a thickness of the loading sheet is equal to or less than 0.09 millimeter.

* * * * *